US005417073A

United States Patent [19]

James et al.

[11] Patent Number: 5,417,073

[45] Date of Patent: May 23, 1995

[54] CRYOGENIC COOLING SYSTEM

[75] Inventors: Timothy W. James; Wallace Y. Kunimoto, both of Goleta, Calif.

[73] Assignee: Superconductor Technologies Inc., Santa Barbara, Calif.

[21] Appl. No.: 92,976

[22] Filed: Jul. 16, 1993

[51] Int. Cl.[6] ..... F25B 19/00

[52] U.S. Cl. ..... 62/51.1; 62/316; 165/104.33; 505/779; 505/892

[58] Field of Search ..... 62/51.1, 51.3, 316; 165/104.33; 505/779, 892

[56] References Cited

U.S. PATENT DOCUMENTS

| | | | |
|---|---|---|---|
| 3,258,602 | 6/1966 | Promish | 62/51.1 |
| 3,609,992 | 10/1971 | Cacheux | 62/51.1 |
| 3,611,746 | 10/1971 | Marsing et al. | 62/51.1 |
| 4,218,892 | 8/1980 | Stephens | 62/51.1 |

FOREIGN PATENT DOCUMENTS

| | | | |
|---|---|---|---|
| 31553 | 3/1977 | Japan | 62/316 |
| 474122 | 1/1976 | U.S.S.R. | 62/316 |

*Primary Examiner*—Ronald C. Capossela
*Attorney, Agent, or Firm*—Lyon & Lyon

[57] ABSTRACT

A Cryogenic Cooling System generally comprises a portable Dewar and a charging station for the Dewar. In the preferred embodiment, a HTSC device, such as a MRI coil, is contained in the Dewar which uses liquid nitrogen as a cryogenic coolant. The Dewar includes a reservoir for holding cryogenic fluid, an optional wicking material, a transfer tube between the reservoir and the HTSC device (or wick), and a vacuum space. Preferably a vent channel is adjacent the reservoir and provides an escape path for evaporating gas from the wick and/or HTSC device. The vent channel preferably provides a feed-back system: as more cryogenic coolant is transferred via the transfer tube, more cool gas is vented through the channel which cools the reservoir and thereby reduces the transfer. A charging system may also be provided as a source of cryogenic coolant. In the preferred embodiment, the charging system comprises a relatively large reservoir for liquid nitrogen.

22 Claims, 12 Drawing Sheets

CRYOGENIC COOLING SYSTEM

FIELD OF THE INVENTION

The present invention relates to magnetic resonance imaging (MRI), particularly an apparatus which includes a high temperature superconductor (HTSC) sensor for use as a detector in MRI. This invention also relates to an apparatus which is capable of containing cryogenic fluids such as liquid nitrogen for cooling a HTSC sensor. This invention further relates to a apparatus comprising a fill station for dispensing liquid nitrogen.

BACKGROUND

Superconductivity refers to that state of metals and alloys in which the electrical resistivity is zero when the specimen is cooled to a sufficiently low temperature. The temperature at which a specimen undergoes a transition from a state of normal electrical resistivity to a state of superconductivity is known as the critical temperature ("$T_c$")

Until recently, attaining the $T_c$ of known superconducting materials required the use of liquid helium and expensive cooling equipment. However, in 1986 a superconducting material having a $T_c$ of 30K was announced. See, e.g., Bednorz and Muller, Possible High Tc Superconductivity in the Ba—La—Cu—O System, Z.Phys. B-Condensed Matter 64, 189–193 (1986). Since that announcement superconducting materials having higher critical temperatures have been discovered. Collectively these are referred to as high temperature superconductors (HTSCs). Currently, superconducting materials having critical temperatures in excess of the boiling point of liquid nitrogen, 77K at atmospheric pressure, have been disclosed.

HTSCs have been prepared in a number of forms. The earliest forms were preparation of bulk materials, which were sufficient to determine the existence of the superconducting state and phases. More recently, thin films on various substrates have been prepared which have proved to be useful for making practical superconducting devices. More particularly, the applicant's assignee has successfully produced thin film thallium superconductors which are epitaxial to the substrate. See, e.g., Olson, et al., Preparation of Superconducting TlCaBaCu Thin Films by Chemical Deposition, Appl. Phys. Lett. 55, No. 2, 189–190 (1989), incorporated herein by reference. Techniques for fabricating and improving thin film thallium superconductors are described in the following patent and copending applications: Olson, et al., U.S. Pat. No. 5,071,830, issued Dec. 10, 1991; Controlled Thallous Oxide Evaporation for Thallium Superconductor Films and Reactor Design, U.S. Pat. No. 5,139,998, issued Aug. 18, 1992; In Situ Growth of Superconducting Films, Ser. No. 598,134, filed Oct. 16, 1990; Passivation Coating for Superconducting Thin Film Device, Ser. No. 697,660, filed May 8, 1991; and Fabrication Process for Low Loss Metallizations on Superconducting Thin Film Devices, Ser. No. 697,960, filed May 8, 1991, all incorporated herein by reference.

High temperature superconducting materials are now routinely manufactured as films having surface resistances significantly below 500 $\mu\Omega$ measured at 10 GHz and 77K. These films may be formed into resonant circuits. Such superconducting films when formed as resonators have an extremely high quality factor ("Q").

The Q of a device is a measure of its lossiness or power dissipation. In theory, a device with zero resistance (i.e. a lossless device) would have a Q of infinity. Superconducting devices manufactured and sold by applicant's assignee routinely achieve a Q in excess of 15,000. This is high in comparison to a Q of several hundred for the best known non-superconducting conductors having similar structure and operating under similar conditions.

Superconducting thin films formed as resonators have the desirable property of having very high energy storage in a relatively small physical space. Such superconducting resonators are compact and lightweight. Another benefit of superconductors is that relatively long circuits may be fabricated without introducing significant loss. For example, an inductor coil of a detector circuit made from superconducting material can include more turns than a similar coil made of non-superconducting material without experiencing a significant increase in loss as would the non-superconducting coil. Therefore, a superconducting coil has increased signal pick-up and is much more sensitive than a non-superconducting coil.

Typical resonant circuits are generally limited in their application due to their signal-to-noise ratios ("SNR"). For example, the SNR in a pickup coil of a MRI detector is a limiting factor for low-field MRI systems. Although the low-field MRI systems have a number of advantages over high-field MRI (including cost, site requirements, patient comfort and tissue contrast), they have not yet found wide-spread use in the U.S. because, in part, of their lower SNR. Resonant circuits made from superconductors improve SNR for low-field human imaging. Therefore, an appropriate superconducting resonant circuit, depending on the field level, coil type, and imaging region, will enable wide-spread use of low-field MRI.

An MRI detector including a low temperature superconducting coil and capacitor has been described. See, e.g., Rollwitz, U.S. Pat. No. 3,764,892, issued Oct. 9, 1973. In addition, resonant circuits for use as MRI detectors which include high temperature superconducting coils and non-superconducting capacitors have been described. See, e.g., Wang, et al., Radio-Frequency Losses of $YBa_2Cu_3O_{7-\delta}$ Composite Superconductors, Supercond. Sci. Technol. 1, 24–26 (1988); High Tc Used in MRI, Supercond. Indus. 20 (Winter 1990); and Hall, et al., Use of High Temperature Superconductor in a Receiver Coil for Magnetic Resonance Imaging, Mag. Res. in Med. 20, 340–343 (1991). Furthermore, devices including high temperature superconducting capacitors and inductors having various structures which may be used, for example, in resonant circuits for use in MRI detectors have been described. See copending patent application: James, et al., SUPERCONDUCTING CONTROL ELEMENTS FOR RF ANTENNAS, Ser. No. 07/934,921, filed Aug. 25, 1992, incorporated herein by reference. Resonant circuits made from HTSCs enjoy increased SNR and Q values.

However, HTSC sensors must be cooled to $T_c$ temperatures and, when they are used as MRI detectors, they must be cooled without exposing a patient to danger. In addition, any apparatus in which the sensor is contained must not interfere with detection of the MRI signal. A safe, unobtrusive, and non-interfering apparatus which could be used to contain a HTSC MRI detector at its $T_c$ has not been shown.

Different approaches to this problem are possible. First, an apparatus could be made which uses an active refrigeration unit to cool the high temperature superconductor detector. However, such refrigeration units are generally bulky, noisy, and magnetic. A bulky or noisy apparatus would not be preferable for use with a patient. A device which generates magnetic fields could not be used near a HTSC MRI detector because the magnetic fields would scramble the signals the HTSC sensor was to detect. In addition, it would be difficult to build an active refrigeration unit of material which would not interfere with the detection of the MRI signal (e.g. built of material which was non-conductive and low loss dielectric).

Second, a Joule-Thomson cooler could be used. However, Joule-Thomson coolers require a large source of compressed gas held at high pressure. Maintaining a large source of highly pressurized compressed gas is expensive and requires cumbersome equipment. For example, a system using a Joule-Thomson cooler would require a long high pressure tubing leading from the source of the pressurized gas to the apparatus containing the HTSC detector.

Third, a device could be constructed which uses a coil and tubing system through which liquid nitrogen from a remote reservoir is pumped to cool a HTSC MRI detector. However, such a device would be bulky and difficult to use. In addition, materials for the coil and tubing must be flexible at liquid nitrogen temperatures and must be well insulated to avoid temperature conduction with the surroundings. Furthermore, it would be difficult to build such a device out of materials which would not interfere with detection of the MRI signal.

As mentioned above, a high temperature superconductor sensor for use as a MRI detector must be cooled to cryogenic temperatures (i.e. below its $T_c$). In addition, any apparatus in which the sensor is contained must not interfere with detection of the MRI signal and must be safe and unobtrusive when the MRI is being performed. No optional solution has been proposed heretofore.

SUMMARY OF INVENTION

A preferred embodiment of the present invention provides a novel apparatus which is capable of containing a high temperature superconducting sensor for use as a MRI detector. Specifically, the preferred embodiment comprises a portable Dewar container portion which is capable of holding a HTSC sensor and storing a cryogenic fluid such as liquid nitrogen such that the sensor is cooled to its $T_c$. In addition, the preferred design of the Dewar container portion allows it to be made from material which is non-conductive and a low-loss dielectric such that there is no interference with detection of an MRI signal. Furthermore, the preferred Dewar container does not generate magnetic fields which could also interfere with detection of the MRI signal.

The preferred portable Dewar container is designed to maximize safety and minimize user and patient exposure to liquid nitrogen. It preferably includes such safety features as a check valve and escape tubing for directing any evaporating nitrogen away from any user or patient and for directing away any escaping nitrogen in case the Dewar container is accidentally broken. It preferably also includes components for enabling mating of the Dewar container with a charging station and enabling automatic transfer of liquid nitrogen from the charging station to the Dewar container.

The present embodiment preferably also includes a charging station which is capable of holding a larger store of liquid nitrogen than is the Dewar container. The preferred charging station is also capable of mating with the portable Dewar container and of dispensing said liquid nitrogen into the Dewar container. The charging station preferably is mobile, easy to operate, safe, and is designed to minimize loss of liquid nitrogen while storing and while transferring the liquid nitrogen.

Accordingly, it is a principal object of this invention to provide an apparatus for containing a high temperature superconductor sensor to be used as a MRI signal detector.

It is also an object to provide an apparatus for dispensing liquid nitrogen into another apparatus.

It is another object of this invention to provide a Dewar container which is made from a material which does not interfere with the detection of an MRI signal.

It is an additional object of this invention to provide a Dewar container which is capable of containing an HTSC sensor for detecting MRI signals and containing a supply of liquid nitrogen for cooling the HTSC sensor.

It is a further object of this invention to provide an apparatus for dispensing liquid nitrogen into a Dewar container which is capable of containing an HTSC sensor and a supply of liquid nitrogen for cooling the HTSC sensor.

It is yet a further object of this invention to provide a portable Dewar container which is capable of mating with a charging station for enabling automatic transfer of liquid nitrogen from the charging station to the Dewar container.

It is still an additional object of this invention to provide a charging station which is capable of holding a large store of liquid nitrogen and is capable of mating with a portable Dewar container such that said liquid nitrogen may be dispensed into the Dewar container.

It is also another object of this invention to provide a safe, simple, and easy-to-use system for detecting MRI signals comprising a portable Dewar container for containing an HTSC sensor for detecting MRI signals and, the system further comprising a charging station for storing and dispensing liquid nitrogen into the Dewar container.

DETAILED DESCRIPTION OF THE PREFERRED EMBODIMENT

The present invention comprises a novel device: a portable container for holding a high temperature superconducting sensor (a HTSC sensor) for detecting MRI signals. The present invention also comprises a novel charging station for introducing liquid nitrogen into the portable container. The portable container and the charging station work together to enable using HTSC sensors as detectors in MRI procedures.

Figure 1A:
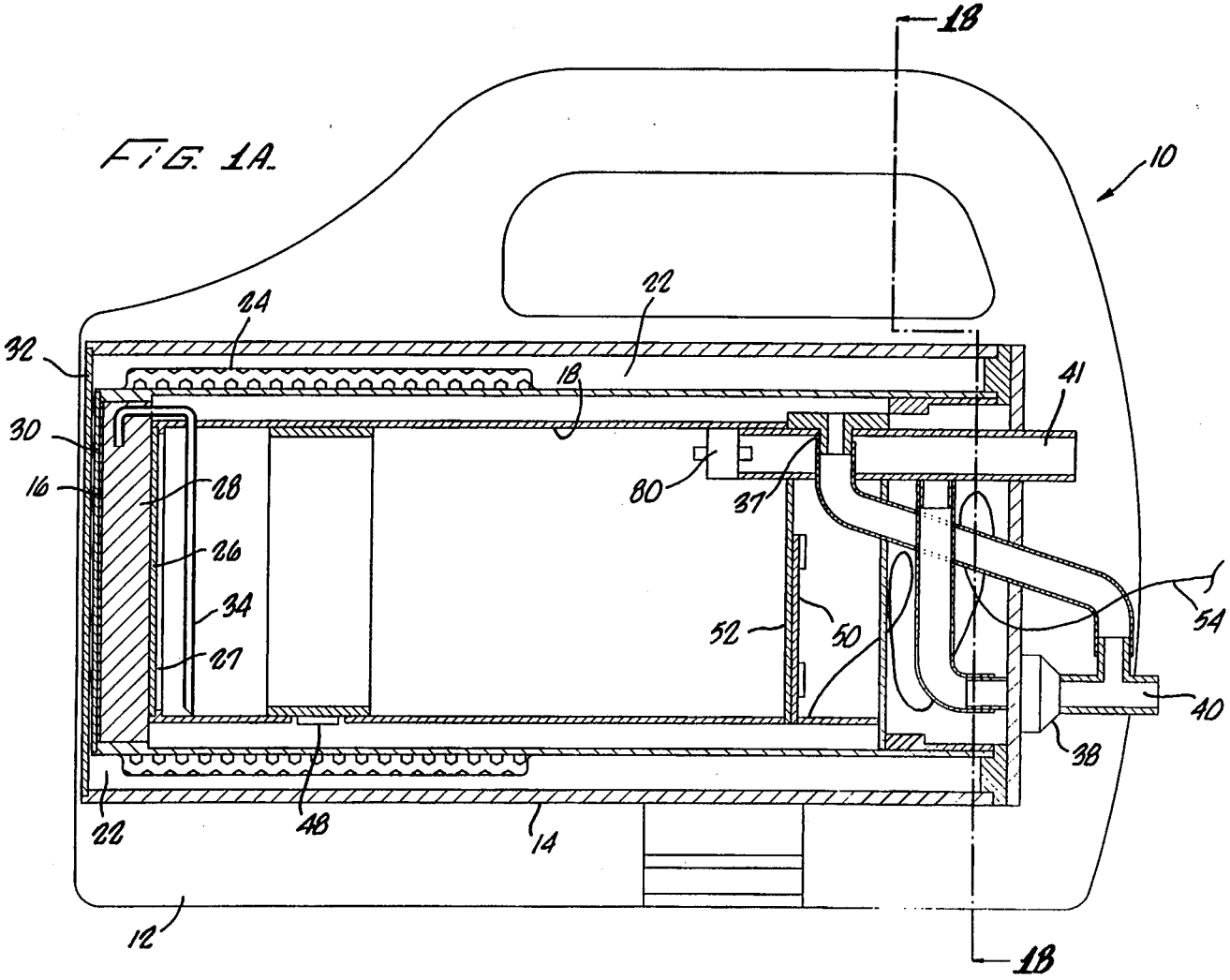
FIG. 1A is a cross-sectional side view of a portable Dewar container of the present invention.

Turning to the portable containers in detail, FIGS. 1A, 1B, 5A, and 5B show views of a portable Dewar container 10 of the present invention. As shown in FIG. 1A, the Dewar container 10 comprises two elements: (1) a generally cylindrical molded outer casing 12 having an integrally molded handle 13 along one side of the cylinder (FIGS. 1A, 1B, 5A, and 5B), and (2) a generally cylindrical Dewar insert 14 (shown in detail in FIG. 1E) which is designed to fit within the molded casing 12.

The Dewar insert 14 is designed to hold a HTSC sensor 16 and to enable using the HTSC sensor 16 to detect MRI signals. The generally cylindrical Dewar insert 14 includes a HTSC sensor 16 positioned near one end of the Dewar insert cylinder (FIG. 1E). A major portion of the insert 14 comprises a generally cylindrical interior reservoir 18 for holding liquid nitrogen 20 (FIG. 1E). The interior reservoir 18 is designed to accommodate liquid nitrogen 20 for cooling the HTSC sensor 16 in amounts sufficient to last time periods sufficient for an MRI procedure to be performed. Typically, the MRI procedure lasts less than one hour.

As shown in FIG. 1E, the interior reservoir 18 is surrounded by a vacuum space 22 for providing insulation between the liquid nitrogen 20 in the interior reservoir 18 and the insert 14 (FIG. 1A) and, therefore, the molded casing 12 and the atmosphere. Within the vacuum space 22 and surrounding a portion of the sides of the interior reservoir 18 preferably is a sleeve 24. The sleeve 24 is preferably filled with activated charcoal or comprises a molecular sieve to provide a condensate surface which helps maintain the vacuum in the vacuum space 22. In addition, the capacity of the activated charcoal and molecular sieve increases when liquid nitrogen temperatures are reached. Therefore, a good vacuum is maintained in the vacuum space 22 at such lower temperatures. The sleeve 24 is preferably made of Dacron®. The Dewar insert 14 includes an evacuation port 25 which communicates the vacuum space 22 to an end of the Dewar insert 14 (see FIG. 1B). The evacuation port 25 enables a vacuum to be drawn in the vacuum space 22.

Further shown in FIG. 1E, the interior reservoir 18 is preferably separated from the HTSC sensor 16 by several layers of various materials. Particularly, the end wall of the interior reservoir 18 is spaced from an alumina or yttrium stabilized zirconia plate 26 which is in contact with a foam or felt wick 28 which is in direct contact with the HTSC sensor 16. Thus, the sensor 16 is separated from the interior reservoir 18 by a layer of felt, a layer of alumina, and an air-gap 27 (FIG. 1E). The sensor 16 is protected on its side opposite the interior reservoir 18 by two additional alumina plates 30 and 32 which are separated by the insulating vacuum space 22 (FIG. 1E). As shown in FIG. 1E, plate 30 abuts the sensor 16 on its side opposite the felt wick 28 and end plate 32 comprises the end of the generally cylindrical Dewar insert 14. Thus, the HTSC sensor is both well insulated and well protected. Preferably the vacuum space 22 continues between plate 30 and end plate 32.

Figure 5A:
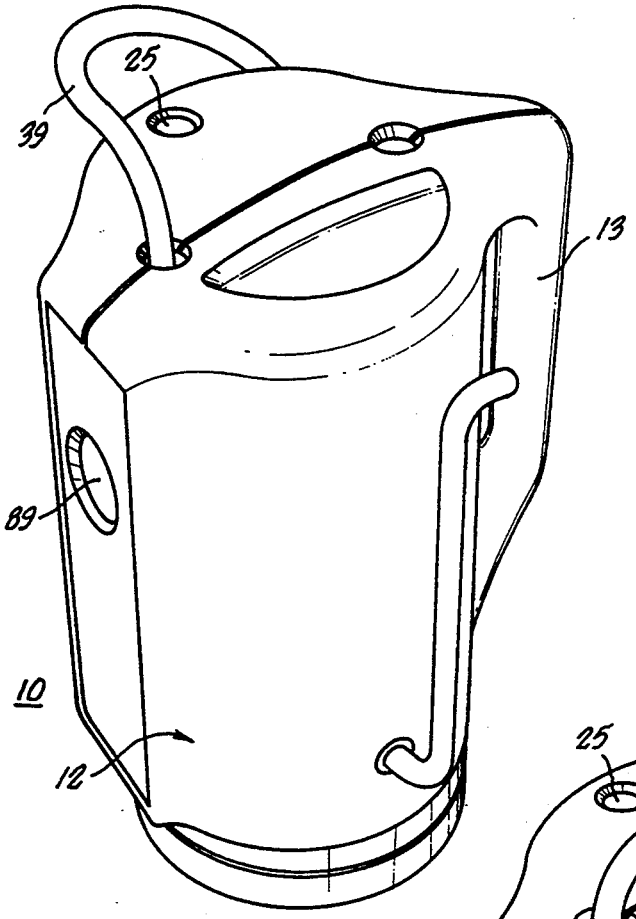
FIGS. 5A and 5B respectively show perspective views of a portable Dewar without and with exhaust tubing collected on a tubing arm.
Figure 5B:
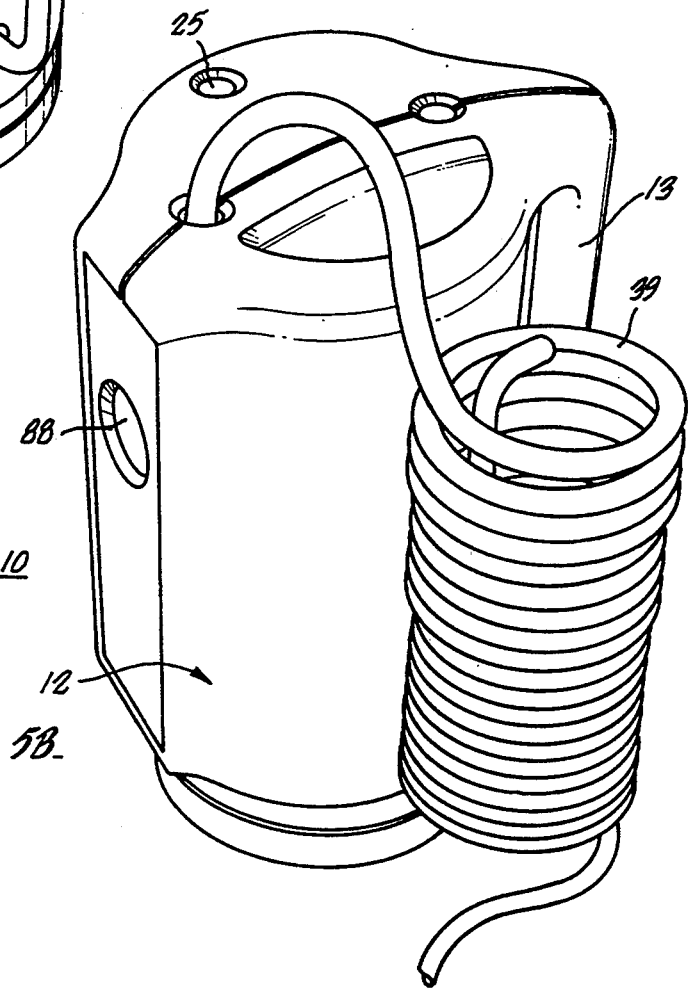

The liquid nitrogen 20 within the interior reservoir 18 of the Dewar insert 14 is used to cool the HTSC sensor 16 via a self-regulating feed. The interior reservoir 18 includes a transfer tube 34 which communicates liquid nitrogen 20 to the wick 28 which, as described above, is in direct thermal contact with the HTSC sensor 16 (see FIG. 1E) and which insures that the HTSC sensor 16 is at liquid nitrogen temperatures (described in detail below). The wick 28 also connects with a venting channel 36 which extends along the exterior surface of the interior reservoir 18 to a vent tubing 37 which ends at an atmosphere exhaust port 40 (FIG. 1E) which may connect to tubing 39 (FIGS. 5A and 5B). The venting channel 36 and the vent tubing 37 enable gaseous nitrogen to vent out of the Dewar insert 14 through the exhaust port 40.

As shown in FIG. 1E, the transfer tube 34 is designed such that it has an inlet end positioned near the bottom of the interior reservoir 18, middle portion extending out of the interior reservoir 18 and through the venting channel 36, and an outlet end positioned adjacent to or in the wick 28. Once liquid nitrogen 20 is introduced into the interior reservoir 18 (through a fill port 41, described below), liquid nitrogen 20 is fed via the transfer tube 34 until the wick 28 is saturated. As the liquid evaporates, additional liquid nitrogen 20 is automatically transferred to the wick 28 depending on the temperature of the HTSC sensor 16 and its surroundings.

The temperature of the HTSC sensor 16 and its surroundings is communicated to the interior reservoir 18 and, therefore, is communicated to the liquid nitrogen 20. If the temperature exceeds the boiling point of the liquid nitrogen 20, the liquid nitrogen 20 will evaporate thereby causing pressure to build within the interior reservoir 18 (because it is sealed) which forces the liquid nitrogen 20 through the transfer tube 34 and to the felt wick 28. The transfer of liquid nitrogen 20 to the felt wick 28 causes the HTSC sensor 16 and its surroundings to cool and, therefore, causes the interior reservoir 18 to cool. As the interior reservoir 18 cools, the pressure inside the interior reservoir 18 drops and the delivery of liquid nitrogen 20 decreases. Thus, this system is preferably self-feeding. It does not necessarily require any external pressure source and/or any separate regulating device.

It should be noted that although the interior reservoir 18 is sealed after liquid nitrogen is deposited therein (described below) the interior reservoir 18 communicates with a pressure relief channel 42 which directs the pressure of the interior reservoir 18 to a check valve 38 and the exhaust port 40 (FIG. 1E). Thus, the pressure within the interior reservoir 18 is limited to a maximum pressure setting: the setting of the check valve 38. It should also be noted that the check valve 38 and port 40 are positioned at an end of the Dewar insert 14 (and, therefore, at an end of the portable Dewar container 10) which is opposite the end which contains the HTSC sensor 16 and, therefore, opposite the end of the device which would be proximate to a patient.

These venting features of the Dewar container 10 provide the additional safety feature of dumping liquid nitrogen 20 away from the patient and any personnel if the Dewar insert 14 (or, most likely, one of the alumina plates) was accidentally broken. If such a break occurred, there would be a loss of vacuum from the vacuum space 22 and the boil-off of liquid nitrogen could be fast and severe. The liquid nitrogen 20 from the interior reservoir 18 would be dumped via the check valve 38 and thereby directed away from any patient or personnel via the port 40. In addition, a high pitched whistle (not shown) could be attached to the port 40 such that if there was a rapid boil off of liquid nitrogen 20, such as due to improper use, the whistle would sound and corrective measures could be taken.

The materials comprising the portable Dewar container 10 are preferably non-magnetic. For example, most of the Dewar container 10 parts could be fabricated from glass epoxy composite material. As noted above, the end pieces closest to the HTSC sensor 16 are preferably fabricated from alumina and could also or in the alternative be fabricated from yttrium stabilized zirconia. Generally useful materials would have high modulus of elasticity and high fracture toughness.

Figures 1B, 1C, 1D:
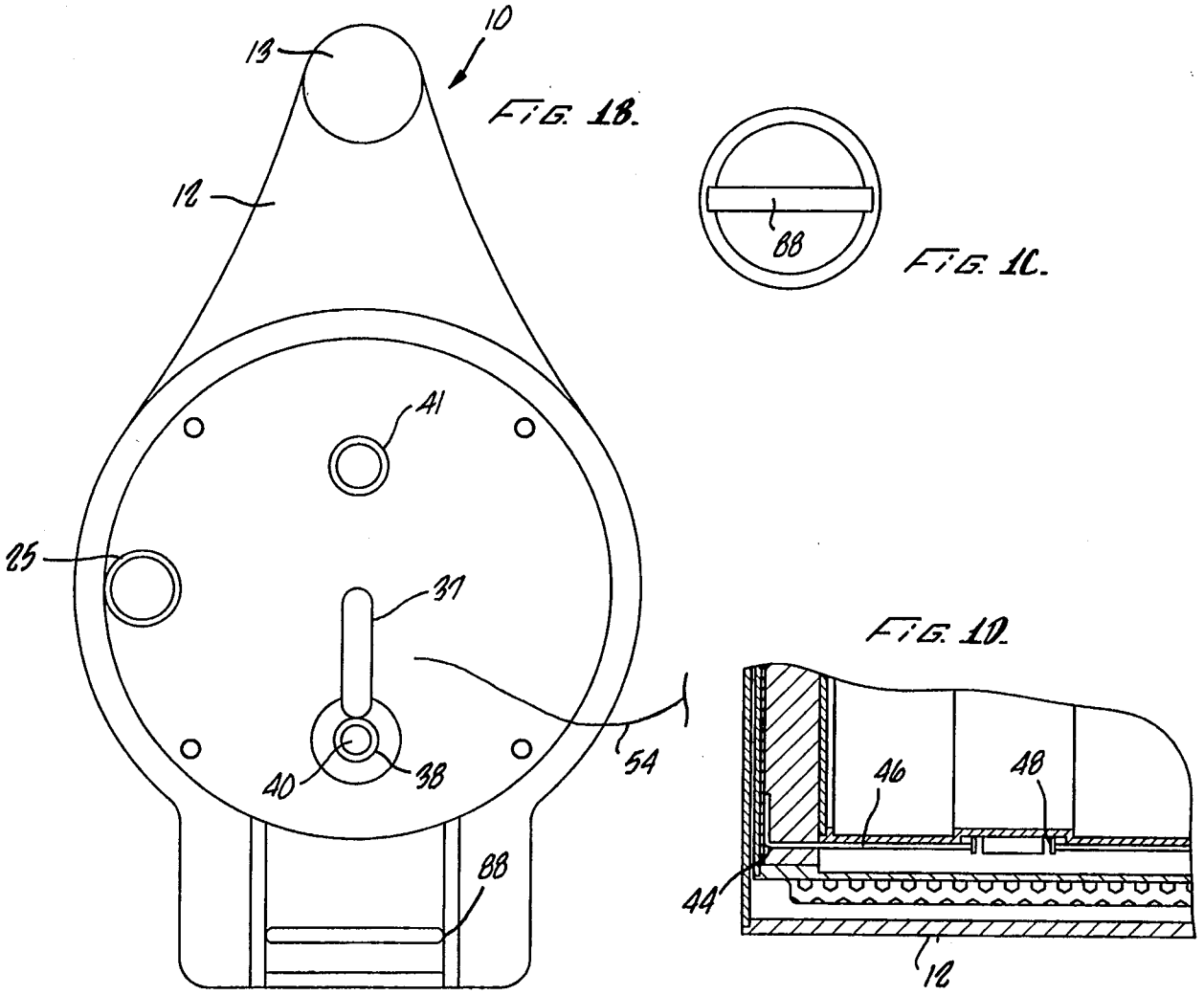
FIG. 1B is a cross-sectional view taken along line 1B—1B of FIG. 1A.
FIG. 1C is a detail of a hinging mechanism of a portable Dewar sensor container of the present invention.
FIG. 1D is an enlarged detail taken from FIG. 1A.
Figure 1E:
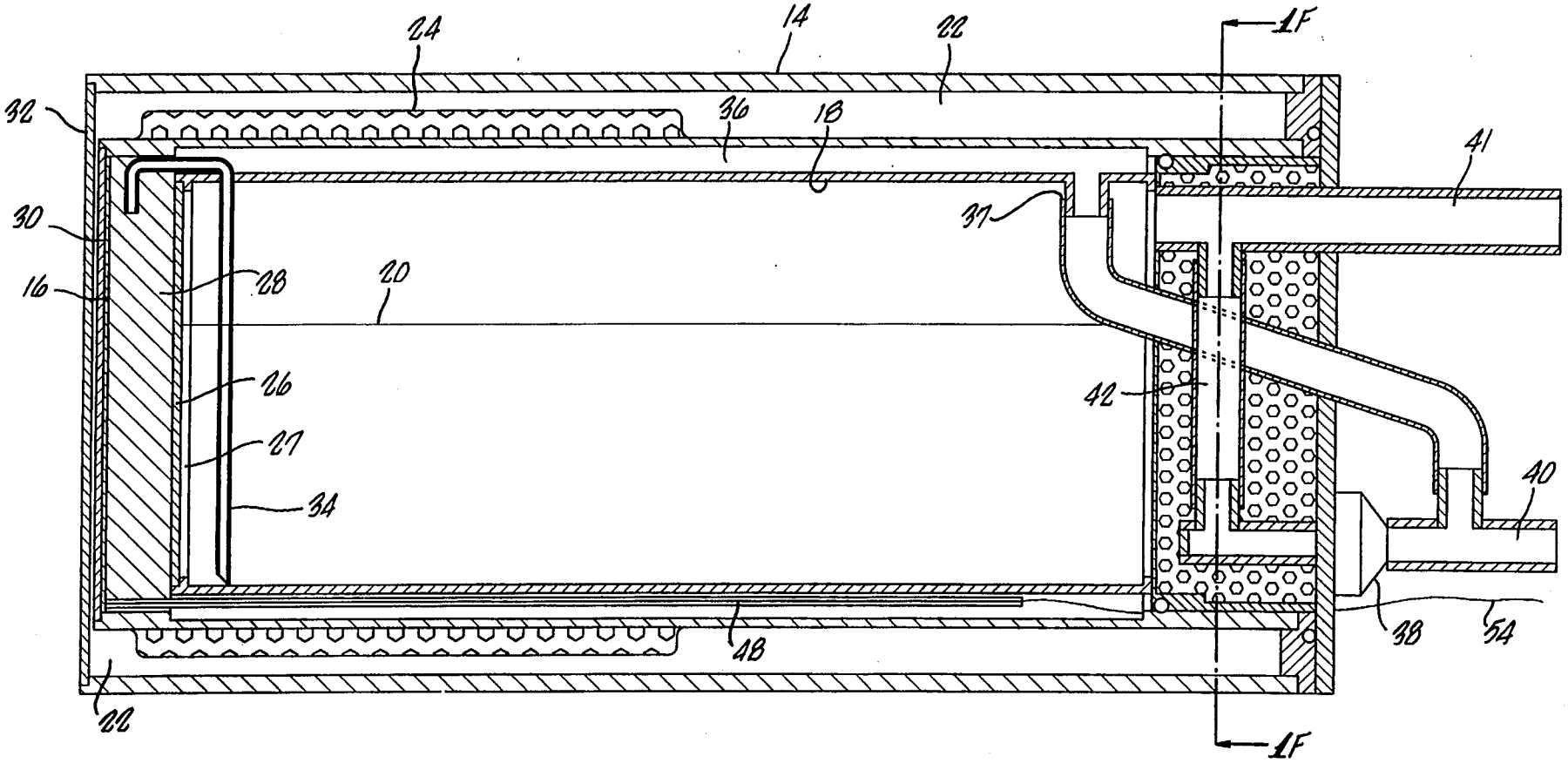
FIG. 1E is an enlarged view of a Dewar insert from a portable Dewar container of the present invention.

As shown in FIGS. 1A, 1D, and 1E, the MRI signals detected by the HTSC sensor 16 are communicated electronically via a cross-over 44, a Z-board 46, a low-noise amplifier 48, an inductor 50, sapphire 52, and wiring 54 to instrumentation (not shown) exterior the Dewar container 10.

Figure 2A:
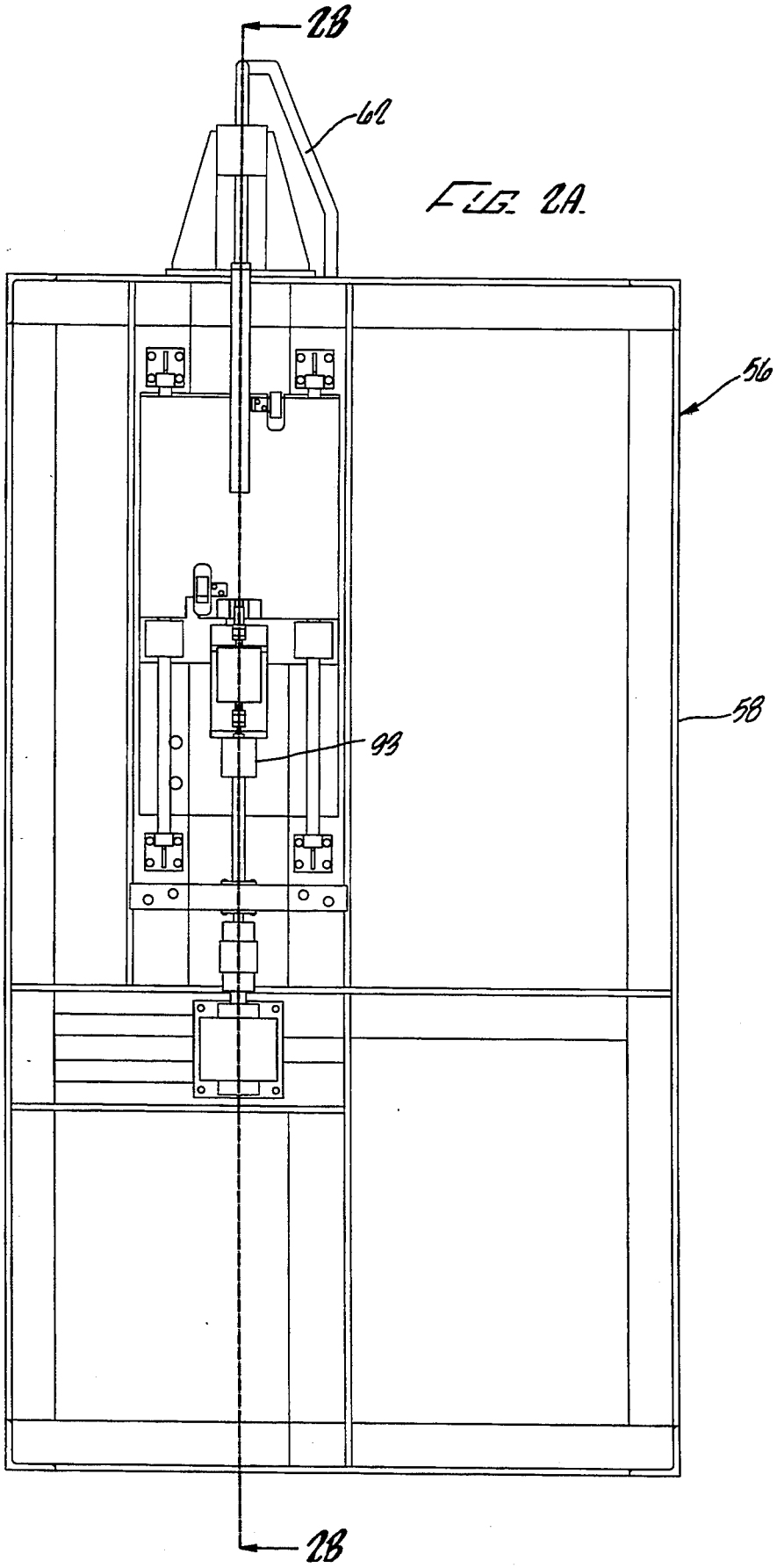
FIG. 2A is a front view of a preferred embodiment of a charging station of the present invention.
Figure 2B:
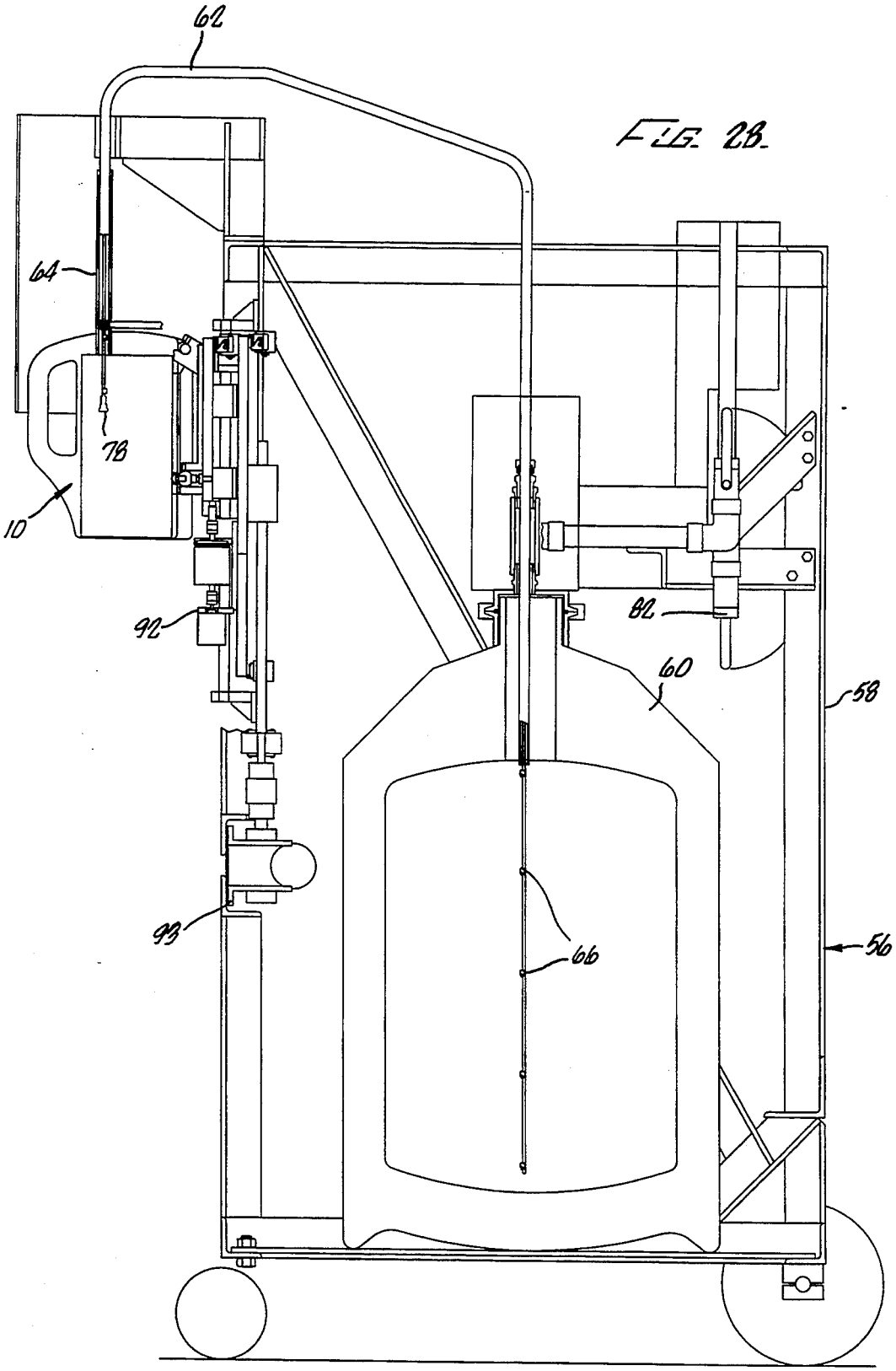
FIG. 2B is a cross-sectional side view of a charging station of the present invention taken along line 2B—2B of FIG. 2A and showing a side view of a Dewar container in phantom.

Turning to the charging station in detail, FIGS. 2A and 2B show views of a Dewar charging station 56 of the present invention. The charging station 56 enables liquid nitrogen to be introduced into the Dewar container 10 and, in particular, into the interior reservoir 18 of the Dewar insert 14, through the fill port 41 on an "as needed" basis. Once liquid nitrogen has been introduced into the interior reservoir 18 of the portable Dewar 10 it is preferable that the interior reservoir 18 be sealed (so the automatic feed of liquid nitrogen to the wick 28 may be accomplished, as described above). Sealing the interior reservoir 18 may be accomplished by placing a cap (not shown) over the fill port 41 when liquid nitrogen delivery is complete.

Figure 2C:
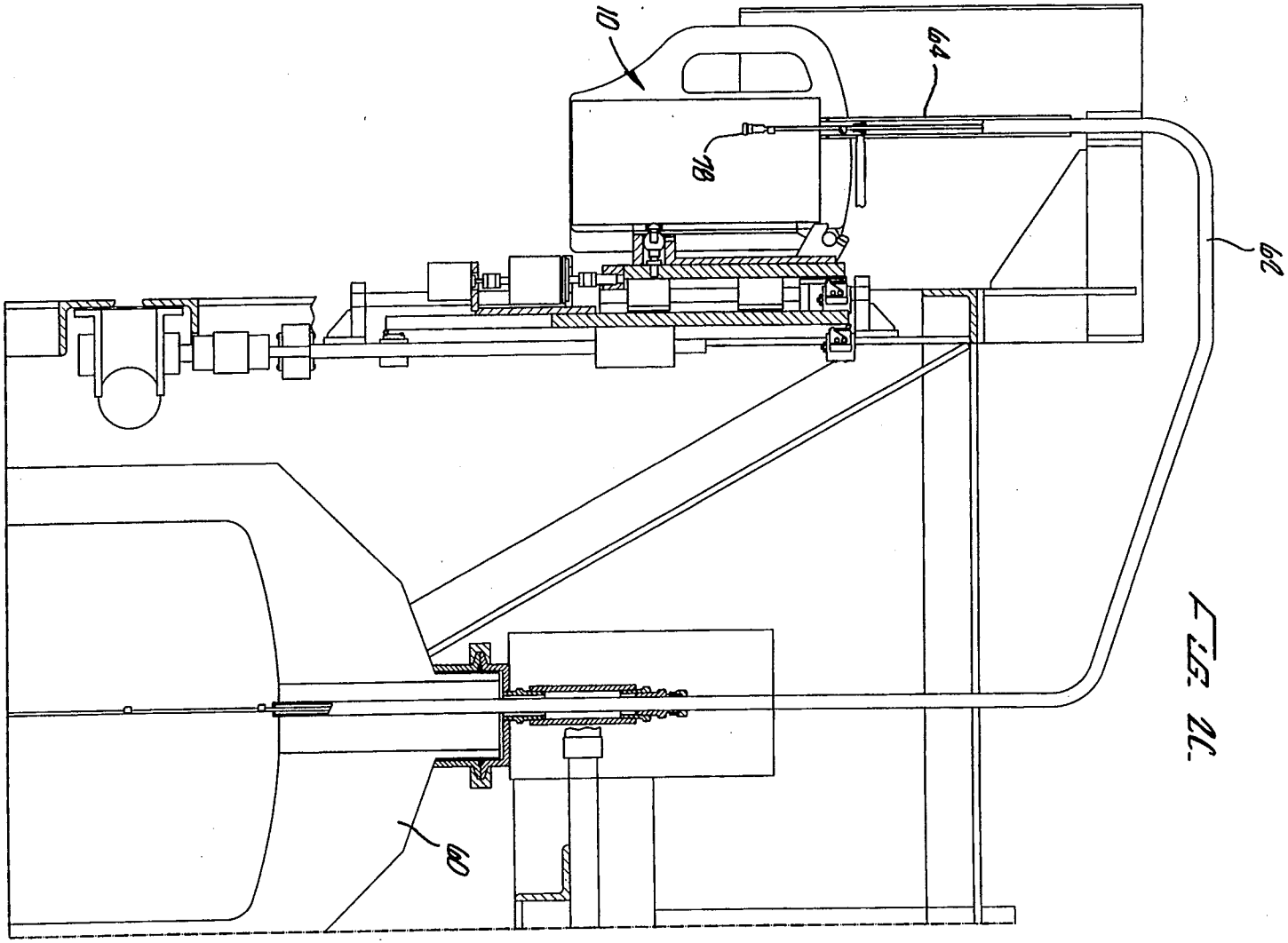
FIG. 2C is an enlarged detail of FIG. 2B.

As shown in FIGS. 2A and 2B, the charging station 56 comprises a frame 58, which holds a liquid nitrogen main storage Dewar 60 (FIGS. 2B and 2C). The liquid nitrogen main storage Dewar 60 preferably comprises a fifty liter Dewar which can store approximately a one month supply of liquid nitrogen.

Figure 3A:
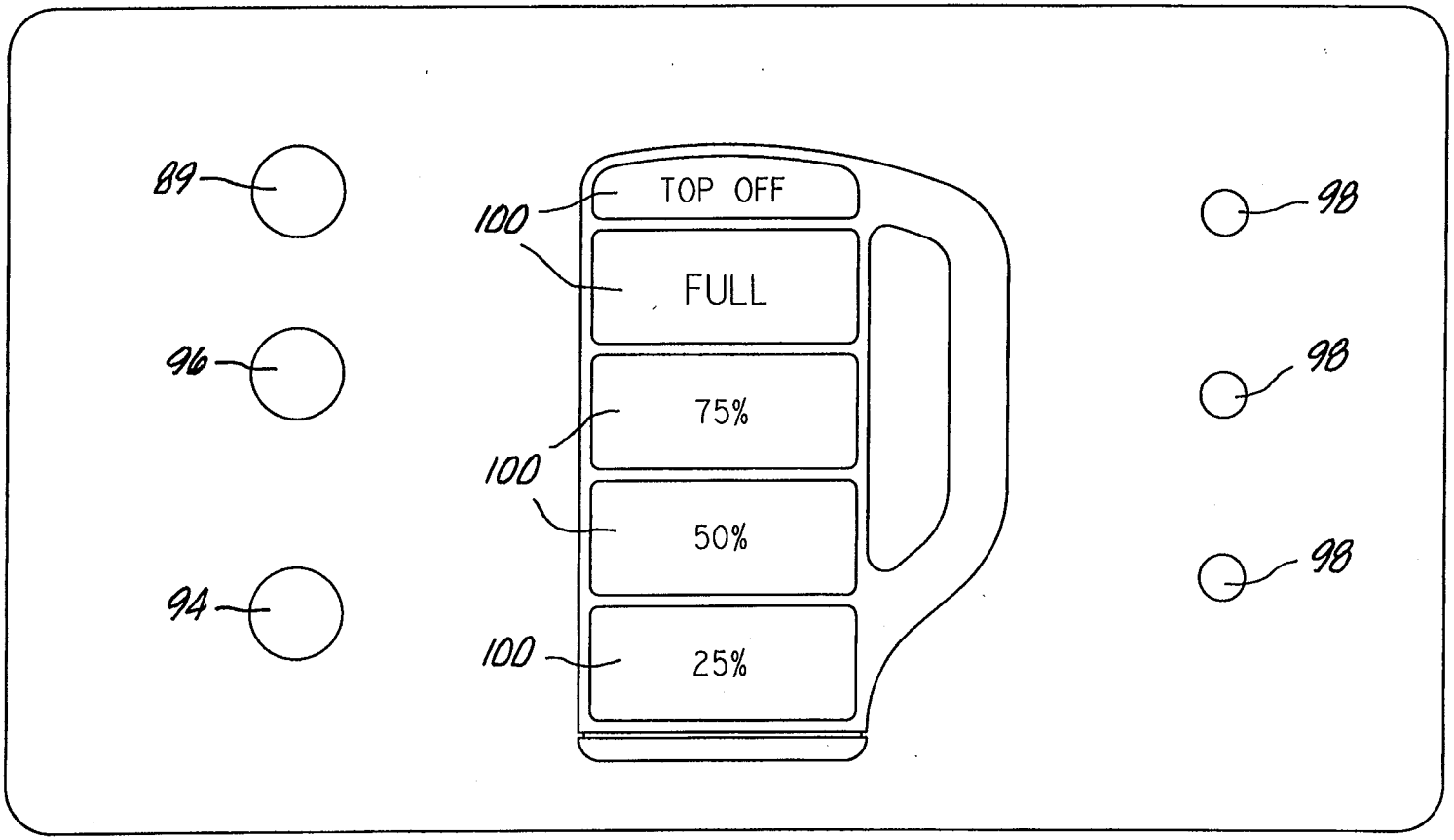
FIG. 3A is a front view of an operation panel for activating the fill operation of the charging station and for showing the amount of liquid nitrogen in the portable Dewar container.
Figure 3B:
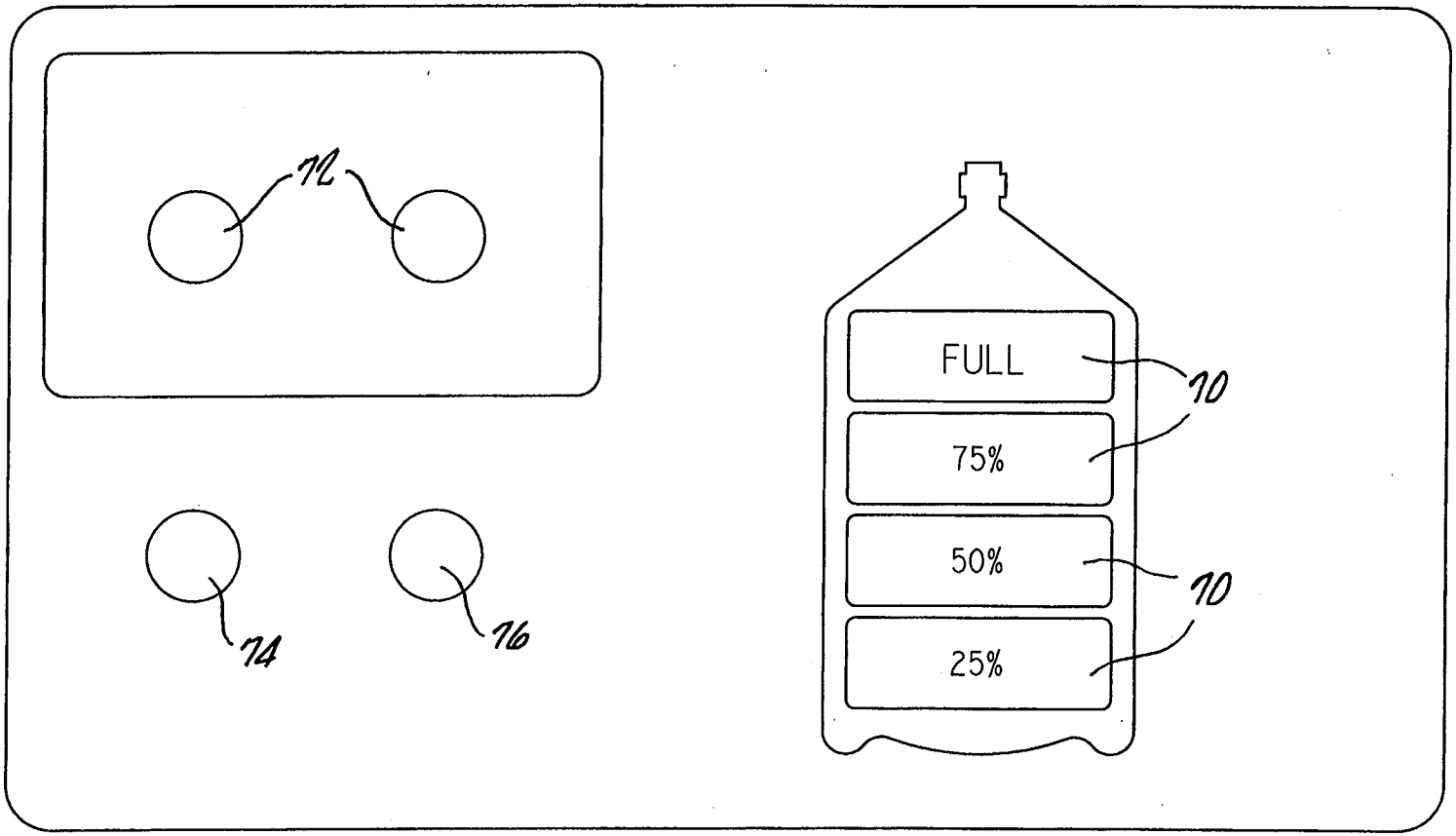
FIG. 3B is a front view of a power and information panel for controlling the operation of the charging station and for showing the charging station's supply of liquid nitrogen.
Figure 6A:
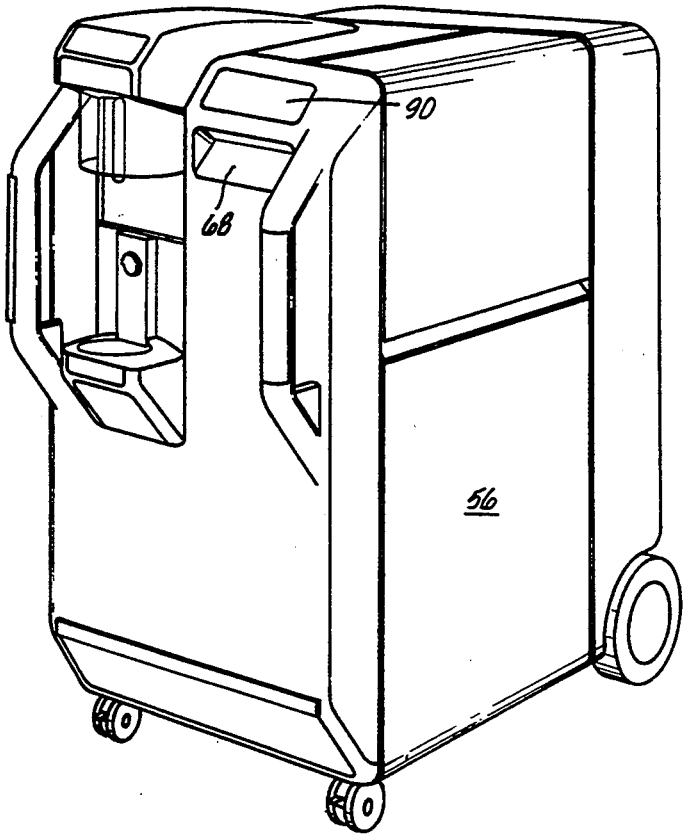
FIGS. 6A and 6B show front perspective views of second and third embodiments respectively of a charging station with and without a shelf for a portable Dewar.
Figure 6B:
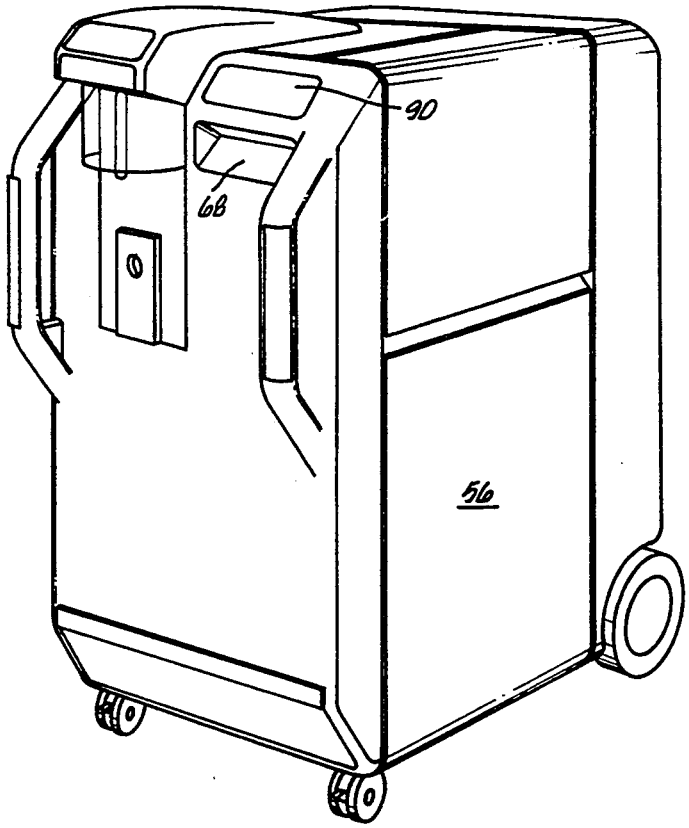
Figure 7A:
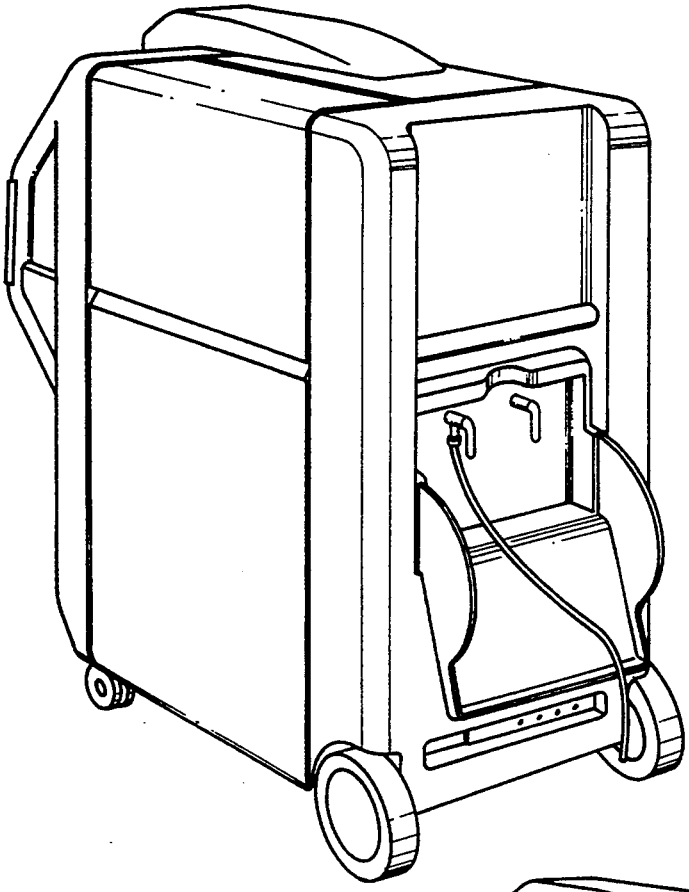
FIGS. 7A and 7B show back perspective views of a fourth embodiment of a charging station with its back panel open and closed, respectively.
Figure 7B:
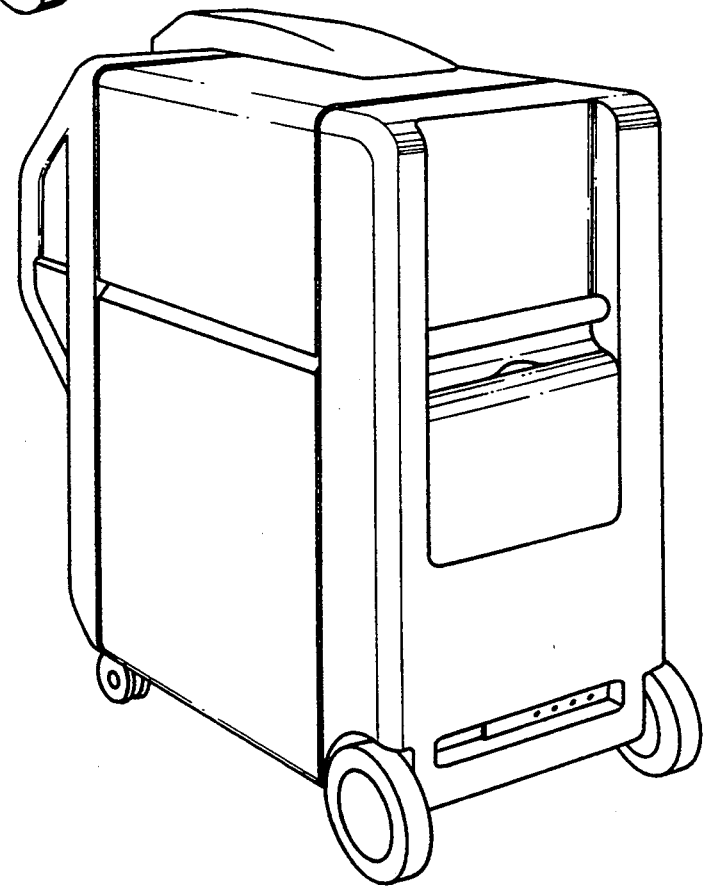

The main storage Dewar 60 includes a vacuum transfer line 62, one end of which extends into the main storage Dewar 60 and an opposite end of which comprises a fill valve 64 which enables the transfer of liquid nitrogen from the main storage Dewar 60 to the portable Dewar container 10. The transfer line 62 includes a plurality of sensors 66 positioned at various elevations along the transfer line 62 which enable detection of the volume or level of liquid nitrogen remaining in the main storage Dewar 60. The sensors 60 are in electronic communication with a control panel 68 (shown in FIG. 3B) positioned on the charging station 56 (FIGS. 6A and 6B). The control panel 68 indicates the liquid nitrogen level within the Dewar 60 by indicator lights 70 (FIG. 3B). The control panel 68 also preferably includes on and off power buttons 72 and status and kill buttons 74 and 76 respectively (FIG. 3B).

The transfer line 62 is unique in that the end comprising the fill valve 64 mates with the Dewar container 10 and has a check valve 78. The check valve 78 comprises a ball and seat arrangement. The Dewar container 10 includes a probe 80 (FIG. 1A) which enables displacement of the ball in the ball and seat arrangement when the fill valve 64 is inserted in the Dewar container 10 through the fill port 41. When the ball is displaced from its seat via the probe 80, gaseous nitrogen starts to flow from the main Dewar 60 through the transfer tube 62 and into the interior reservoir 18 of the portable Dewar 10 followed shortly thereafter by liquid nitrogen. As mentioned above, it is preferable that the interior reservoir 18 of the portable Dewar 10 be sealed, for example, by a cap (not shown) over the fill port 41, after liquid nitrogen transfer from the main Dewar 60 is complete.

This method of transferring liquid nitrogen from the main Dewar 60 conserves liquid nitrogen when compared to a more common method of using a solenoid valve to open or close a transfer line and control the flow of liquid nitrogen. Liquid nitrogen is conserved due to the fact that in a solenoid arrangement the liquid nitrogen must first cool the solenoid valve body and magnet before the liquid nitrogen starts to flow. However, a solenoid valve may be used in the alternative.

The charging station 56 also includes a fill valve 82, a vent valve 84, and a fill vent 86 (FIG. 2B). The valves 82 and 84 and the vent 86, enable the main storage Dewar 60 to be charged with liquid nitrogen from a larger liquid nitrogen storage (not shown).

The preferred charging station 56 shown in FIGS. 2A–2C provides for automatic charging of liquid nitrogen from the main storage Dewar 60 to a portable Dewar container 10. This is accomplished by providing a mating hinge 88 on the Dewar container 10 (FIGS. 1B and 1C). This mating hinge 88 may removably attach to a hook provided on the charging station 56. Once the Dewar container 10 is mated to the charging station 56 and locked into position, a "charge" button 89 may be depressed on a control panel 90 (FIG. 3A) positioned on the charging station 56 (FIGS. 6A and 6B). The button 89 activates a motor 92 causing the Dewar container 10 to raise to the transfer line fill valve 82. At this point a fill button 94 on control panel 90 may then be depressed which causes a second motor 93 to raise the Dewar container 10 to a position such that the filling of liquid nitrogen begins. When a sensor in the check valve 78 determines that the Dewar container 10 is filled, the liquid nitrogen transfer is stopped and the Dewar container 10 is lowered (via motor 93) to a position below the transfer line fill valve 82. At this point, a release button 96 on control panel 90 may be depressed and the Dewar container 10 is further lowered so that it may be removed from the hook on the charging station 56. It is preferable that the control panel 90 include indicator lights 98 to indicate what task is being accomplished by the charging station 56 at any one time. In addition, it is preferable that the control panel 90 further include fill status lights 100 which indicate the fill status of the portable Dewar container 10 once it is raised to the transfer line fill valve 82.

The transfer line fill valve end is preferably designed such that upon release of the Dewar container 10, a sleeve (not shown) which is spring-loaded covers the transfer line fill valve end automatically. The purpose of such a sleeve is to protect any user from frost which will form on the probe due to its exposure to atmosphere after dispensing liquid nitrogen. In addition, it is preferable that a heater (not shown) be provided to warm the end of the transfer line. This would assure a quicker and more reliable gaseous seal at the fill valve 64 in addition to melting any frost which accumulates on the end of the transfer line.

Figure 4:
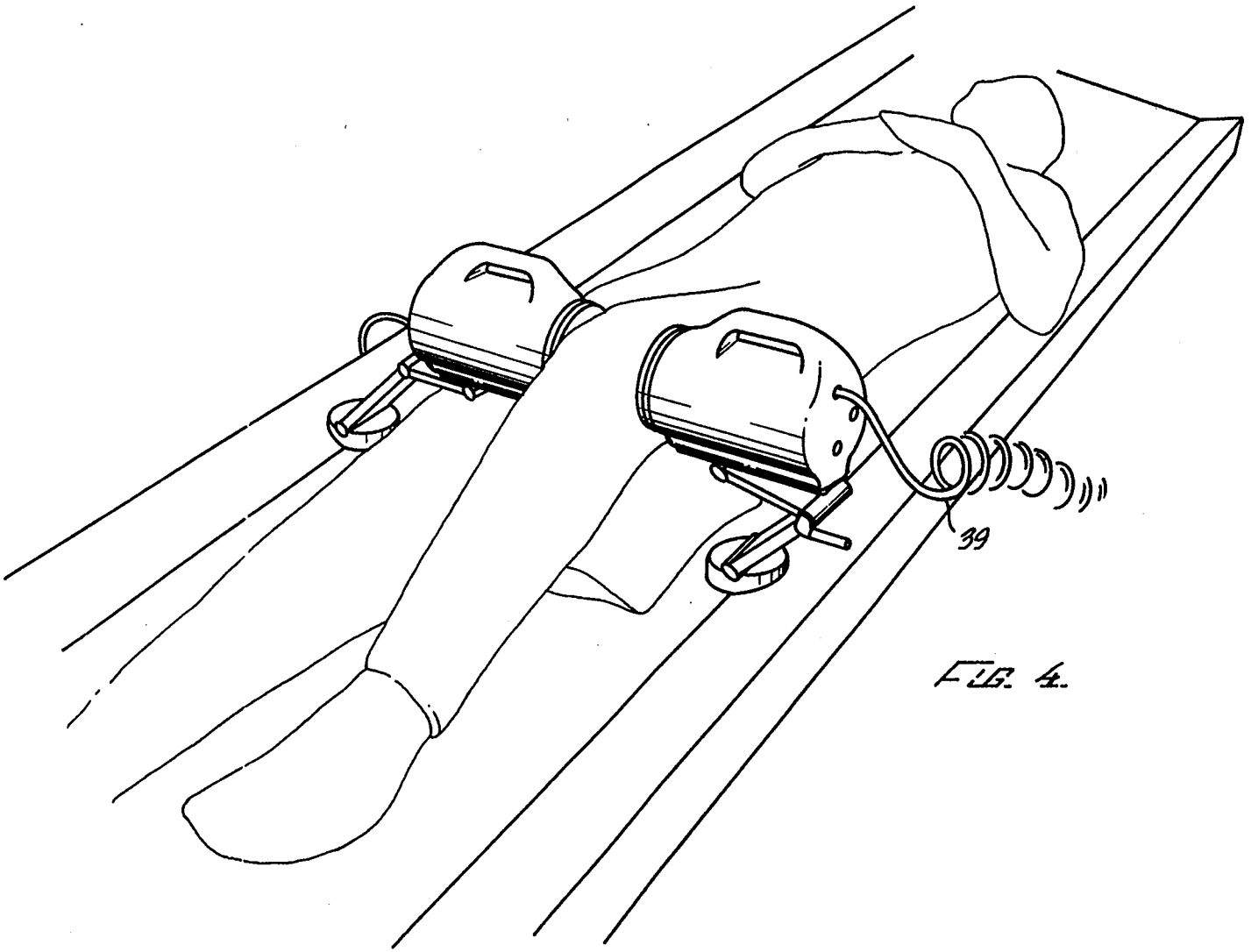
FIG. 4 is a perspective view of two portable Dewar containers of the present invention positioned to detect MRI signals as an MRI is taken of a patient's knee.

FIG. 4 shows a use of the portable Dewar container 10 of the present invention. As shown in FIG. 4, the HTSC sensor ends of each of two portable containers 10 would be positioned on opposite sides of an item being scanned, in this case, a patient's knee.

FIGS. 5A and 5B show perspective views of a portable Dewar container 10 including a tubing arm 100 for storing the exhaust tubing 39. FIG. 5B shows the exhaust tubing 39 coiled and stored on the tubing arm 100.

FIGS. 6A, 6B, 7A, and 7B show additional embodiments of the charging station 56 of the present invention. FIGS. 6A and 6B also show preferable positioning of the control panels 68 and 90.

While embodiments of the present invention have been shown and described, various modifications may be made without departing from the scope of the present invention, and all such modifications and equivalents are intended to be covered.

We claim:

1. A portable Dewar for cooling an object through use of cryogenic fluids comprising a reservoir for holding cryogenic fluid, the reservoir including a fill port, a wicking material adapted to be in thermal contact with the object to be cooled, a transfer tube connected between and coupling the reservoir and the wicking material to permit transfer of the cryogenic fluid from the reservoir to the wicking material, a venting channel adjacent the reservoir and providing a vent for evaporated cryogenic fluid from the wicking material, the evaporated cryogenic fluid having thermal contact with the reservoir, and an outer wall defining a vacuum space circumferentially surrounding the reservoir, venting channel and wicking material.

2. A Dewar as in claim 1 where the cryogenic fluid is liquid nitrogen.

3. A Dewar as in claim 2 wherein the object is a high temperature superconducting device.

4. A Dewar as in claim 3 wherein the high temperature superconducting device is an EM coil.

5. A Dewar as in claim 4 wherein the EM coil is a magnetic resonance imaging detector coil.

6. A Dewar as in claim 1 further including a Dewar container extending to the vacuum space.

7. A Dewar as in claim 1 wherein the wick is foam.

8. A Dewar as in claim 1 wherein the wick is felt.

9. A Dewar as in claim 1 further comprising a sleeve positioned in the vacuum space between the outer wall and the reservoir.

10. A Dewar as in claim 9 wherein the sleeve is Dacron®.

11. A Dewar as in claim 9 wherein the sleeve includes a molecular sieve.

12. A Dewar as in claim 9 wherein the sleeve includes activated charcoal.

13. A Dewar as in claim 1 further including an end plate positioned between the wicking material and the reservoir.

14. A Dewar as in claim 13 wherein the end plate is alumina.

15. A Dewar as in claim 13 wherein the end plate is yttrium stabilized zirconia.

16. A Dewar as in claim 1 further including a charging station for holding and introducing cryogenic fluid into the Dewar.

17. A cooling system for a high temperature superconductor comprising a charging station including a source of liquid nitrogen, and a transfer line, a portable Dewar including a reservoir for holding liquid nitrogen, a fill port adapted to mate with the transfer line of the charging station, a transfer tube extending from the reservoir to a point adjacent a high temperature superconductor to permit transfer of the liquid nitrogen from the reservoir to the point adjacent the high temperature superconductor, and a venting channel for enabling evaporated nitrogen to escape.

18. A system as in claim 17 wherein the source of liquid nitrogen in the charging station is a storage Dewar.

19. A system as in claim 18 wherein the storage Dewar has a storage capacity larger than the reservoir in the portable Dewar.

20. A system as in claim 17 wherein the portable Dewar further includes wicking material contacting the transfer tube at the point adjacent the high temperature superconductor and for wicking liquid nitrogen from the transfer tube.

21. A system as in claim 20 wherein the wicking material is foam.

22. A system as in claim 20 wherein the wicking material is felt.

* * * * *